US008015734B1

(12) United States Patent
Mills et al.

(10) Patent No.: US 8,015,734 B1
(45) Date of Patent: Sep. 13, 2011

(54) MACHINE BUCKET ASSEMBLY

(75) Inventors: Rudy V. Mills, Manhattan, KS (US); Wayne E. Harshberger, II, Oswego, IL (US); Jeffrey K. Berry, Yorkville, IL (US); John R. Picolet, Manhattan, KS (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 12/783,401

(22) Filed: May 19, 2010

(51) Int. Cl.
*E02F 3/40* (2006.01)

(52) U.S. Cl. ..... 37/444

(58) Field of Classification Search ..... 37/465, 37/443–448, 468; 172/772, 772.5, 777; 414/722–724
See application file for complete search history.

(56) References Cited

U.S. PATENT DOCUMENTS

| | | | | | |
|---|---|---|---|---|---|
| 1,653,905 | A | * | 12/1927 | Harrison | 37/444 |
| 2,916,135 | A | * | 12/1959 | Likens, Jr. | 198/705 |
| 2,924,345 | A | * | 2/1960 | Bodin | 414/705 |
| 2,972,425 | A | * | 2/1961 | Anderson et al. | 37/379 |
| 3,243,906 | A | * | 4/1966 | Washbond | 37/444 |
| 3,398,472 | A | * | 8/1968 | Leijon | 37/444 |
| 3,648,391 | A | * | 3/1972 | Kabay et al. | 37/451 |
| 3,775,879 | A | * | 12/1973 | Quick | 37/460 |
| 3,807,587 | A | * | 4/1974 | Maurer | 37/444 |
| RE29,603 | E | * | 4/1978 | Oke et al. | 414/722 |
| 4,086,712 | A | * | 5/1978 | McReynolds | 37/444 |
| 4,279,085 | A | * | 7/1981 | Arnold | 37/444 |
| 4,395,193 | A | * | 7/1983 | Christensen et al. | 414/722 |
| 4,457,085 | A | * | 7/1984 | Arnold | 37/444 |
| 4,459,768 | A | * | 7/1984 | Albrecht | 37/444 |
| 4,523,397 | A | * | 6/1985 | Lucas | 37/444 |
| 5,815,959 | A | * | 10/1998 | Bahner et al. | 37/444 |
| 6,374,520 | B1 | * | 4/2002 | Westendorf et al. | 37/444 |
| 6,581,308 | B1 | * | 6/2003 | Woerman et al. | 37/444 |

FOREIGN PATENT DOCUMENTS

| | | | |
|---|---|---|---|
| JP | 59041533 | A * | 3/1984 |
| JP | 01214623 | A * | 8/1989 |

* cited by examiner

*Primary Examiner* — Robert E Pezzuto
(74) *Attorney, Agent, or Firm* — Finnegan, Henderson, Farabow, Garrett & Dunner LLP

(57) ABSTRACT

A machine bucket may include an upper pin hole and a lower pin hole. The machine bucket may also include a bottom section. A distance between the lower pin hole and a tip of the bottom section may have a first length. The machine bucket may also include a top section. A distance between the lower pin hole and a tip of the top section may have a second length. A ratio of the first length to the second length may be equal to a value between approximately 0.95 and 1.05. The machine bucket may further include a middle section located between the bottom section and the top section. At least a portion of the middle section may be curved.

20 Claims, 5 Drawing Sheets

MACHINE BUCKET ASSEMBLY

TECHNICAL FIELD

This disclosure relates generally to machine bucket assemblies, and more particularly, to performance enhancing machine bucket assemblies.

BACKGROUND

A machine, such as a wheel loader, may be equipped with a bucket assembly to perform operations at a work site. Such operations may include, for example, penetrating material in the ground or in a pile, scooping material, moving material, and depositing the material in a desired location. The level of performance achieved by a wheel loader operator using the wheel loader may depend, at least partially, on one or more parameters of the bucket assembly. Using one bucket assembly may provide a level of performance that significantly differs from the level achieved while performing similar operations using another bucket assembly that has one or more different parameters.

SUMMARY

In accordance with one aspect, the present disclosure is directed to a machine bucket assembly. The machine bucket assembly may include a kinematic reaction point. The machine bucket assembly may also include a bottom section. A distance between the kinematic reaction point and a tip of the bottom section may have a first length. The machine bucket assembly may also include a top section. A distance between the kinematic reaction point and a tip of the top section may have a second length. A ratio of the first length to the second length may be equal to a value between approximately 0.95 and 1.05. The machine bucket assembly may further include a middle section coupled to the bottom section and the top section. At least a portion of the middle section may be curved.

In accordance with another aspect, the present disclosure is directed to a machine bucket assembly. The machine bucket assembly may include a kinematic reaction point. The machine bucket assembly may also include a bottom section. A distance between the kinematic reaction point and a tip of the bottom section may have a first length. A bottom surface of at least a portion of the bottom section may define a cutting edge plane. The machine bucket assembly may further include a top section. A distance between the kinematic reaction point and a tip of the top section may have a second length. A ratio of the first length to the second length may be equal to a value between approximately 0.95 and 1.05. A first angle between a plane perpendicular to the cutting edge plane and a plane extending between the tip of the bottom section and the tip of the top section may be equal to a value ($\alpha$) between approximately 17.8° and 23.8°. A second angle between a plane formed by the top section and the cutting edge plane may be equal to a value ($\beta$) between approximately 23.0° and 29.0°.

In accordance with another aspect, the present disclosure is directed to a machine bucket assembly. The machine bucket assembly may include a kinematic reaction point. The machine bucket assembly may also include a bottom section. A distance between the kinematic reaction point and a tip of the bottom section may have a first length. A bottom surface of at least a portion of the bottom section may define a cutting edge plane. The machine bucket assembly may also include a top section. A distance between the kinematic reaction point and a tip of the top section may have a second length. A ratio of the first length to the second length may be equal to a value between approximately 0.95 and 1.05. A first angle between a plane perpendicular to the cutting edge plane and a plane extending between the tip of the bottom section and the tip of the top section may be equal to a value ($\alpha$) between approximately 18.5° and 24.5°. A second angle between a plane formed by the top section and the cutting edge plane may be equal to a value ($\beta$) between approximately 44.0° and 50.0°.

DETAILED DESCRIPTION

Figure 1:
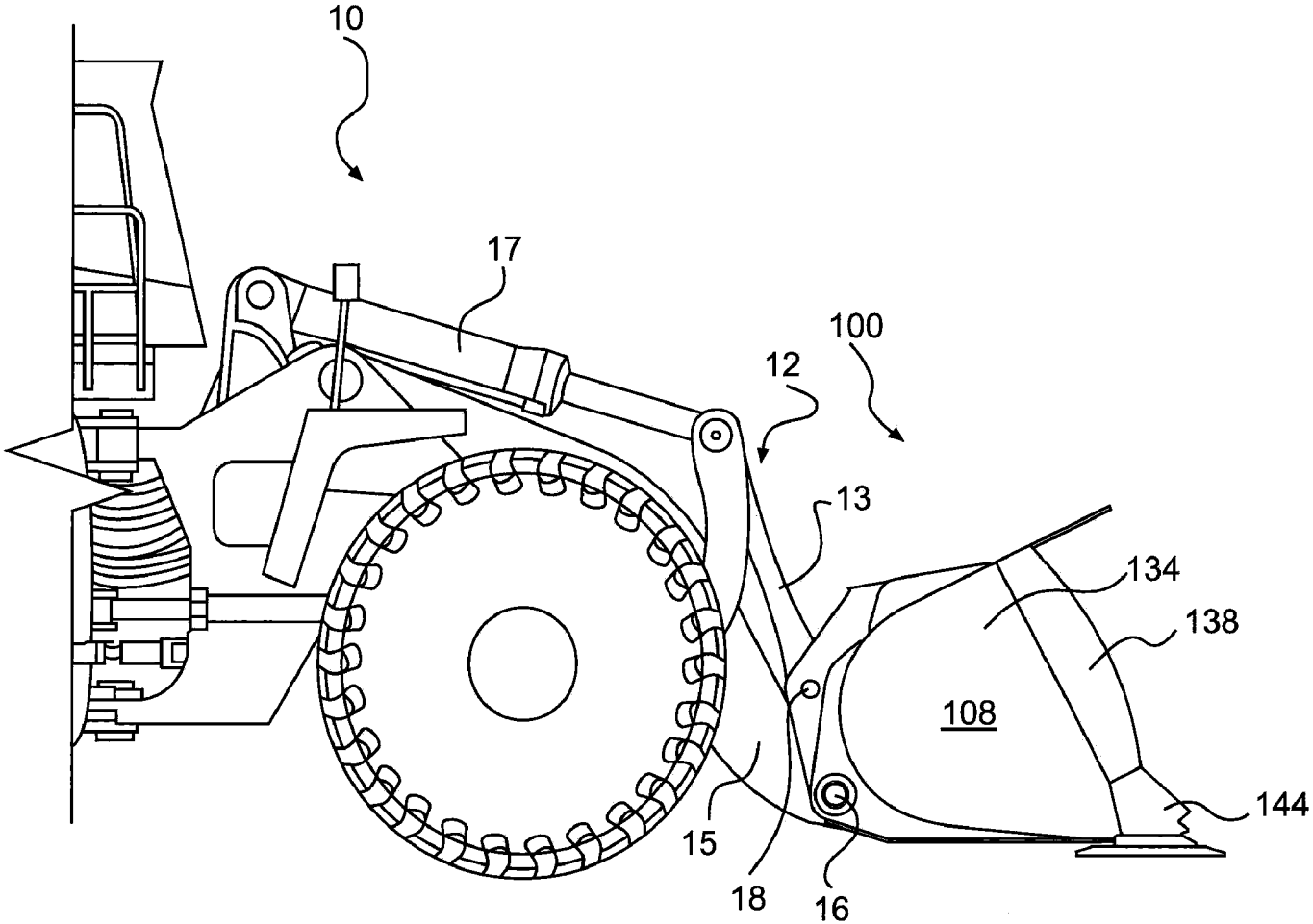
FIG. 1 is a side view of an exemplary machine, with a performance enhancing bucket in a ground level position, according to an aspect of the disclosure.

FIG. 1 illustrates an exemplary machine 10. Machine 10 may embody a mobile machine, such as a wheel loader or any other machine, that performs operations associated with an industry, including, for example, mining, construction, farming, or transportation. Machine 10 may include a linkage assembly 12 coupled to a bucket assembly 100. Linkage assembly 12 may include an upper linkage 13, a lower linkage 15, and an actuator assembly 17, for moving bucket assembly 100 to perform operations, including engaging, scooping, lifting, transporting, lowering, and dumping material. An enlarged view of bucket assembly 100 is shown in FIG. 2.

Figure 2:
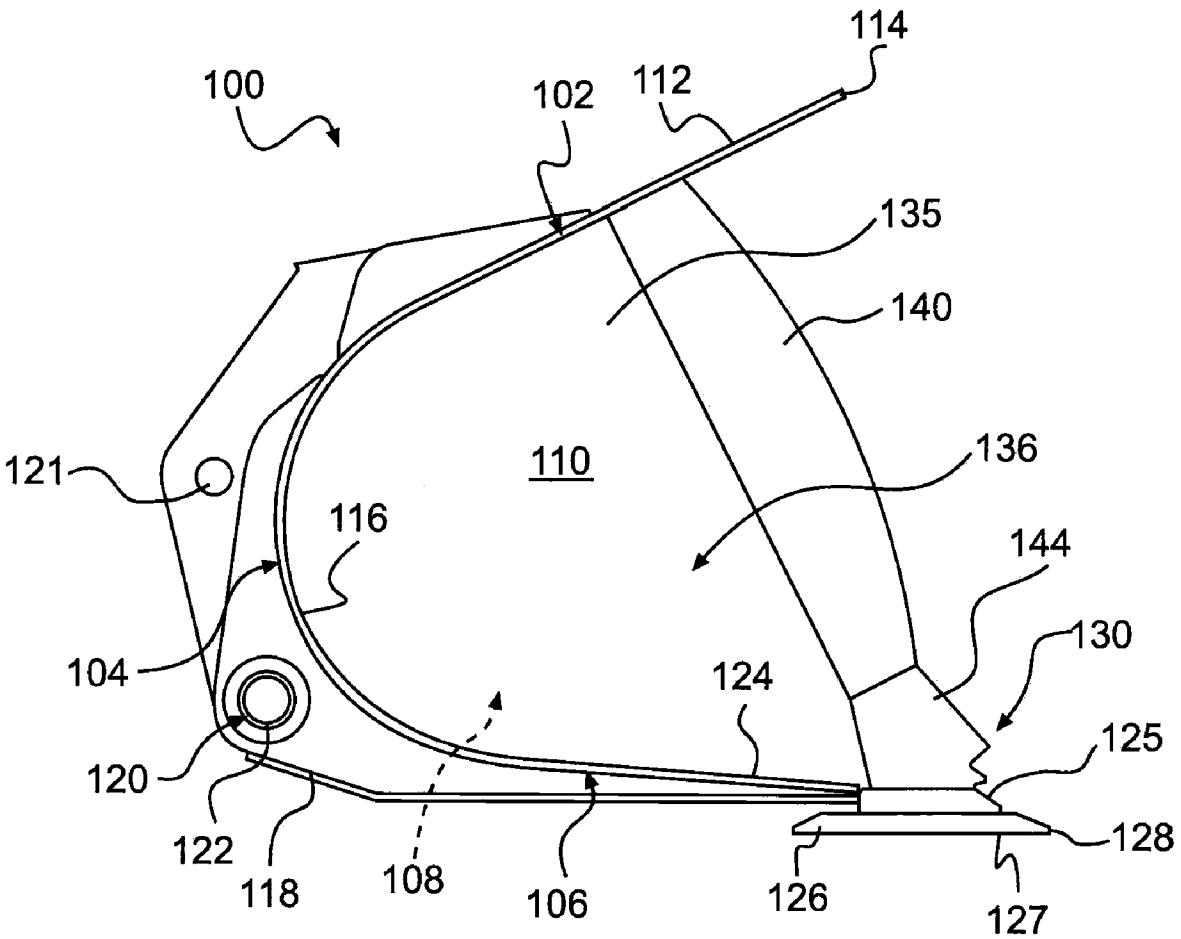
FIG. 2 is an enlarged side view of the performance enhancing bucket of FIG. 1, with a side plate removed for clarity.

Referring to FIG. 2, bucket assembly 100 may include a top section 102, a middle section 104, a bottom section 106, a first side section 108 (shown in FIG. 1, but removed in FIG. 2 to illustrate the inside of bucket assembly 100), and a second side section 110. Middle section 104 may include a curved portion 116.

Coupling components 118, which may include one or more plates and supporting members, may be coupled to a convex side of curved portion 116, and may be used to couple bucket assembly 100 to linkage assembly 12. Coupling components 118 may include an upper pin hole or bore 121 and a kinematic reaction point 120. Upper pin hole or bore 121 may be configured to receive a pin 18 of upper linkage 13 of linkage assembly 12. Kinematic reaction point 120 may include a lower pin hole or bore 122 configured to receive a pin 16 (FIG. 1) of lower linkage 15 of linkage assembly 12. Bore 122 and pin 16 may act as a pivot point for bucket assembly 100, about which bucket assembly 100 rotates relative to lower linkage 15. Linkage assembly 12 may rotate bucket assembly 100 about kinematic reaction point 120 as one or more operations are performed with bucket assembly 100.

Top section 102 of bucket assembly 100 may extend from an upper end of curved portion 116. Top section 102 may include a spill guard 112. Spill guard 112 may be formed by a portion of top section 102, or may be welded to another portion of top section 102. Spill guard 112 may have a width covering at least a portion of a width of bucket assembly 100, with the width of bucket assembly 100 extending from first side section 108 to second side section 110. Spill guard 112 may include a spill guard tip 114.

At least a portion of top section 102 may be substantially straight. Top section 102 may include a tip defined by a portion of top section 102 furthest from kinematic reaction point 120. The tip of top section 102 may include, for example, spill guard tip 114. Top section 102 may also include an extension (not shown), which may be at least partially mounted on a portion of top section 102, such as, for example, on spill guard 112. The extension may have a width less than the width of spill guard 112. For example, the extension may extend across a central portion of spill guard 112. The extension may include a tip portion extending laterally beyond spill guard tip 114. It should be understood that the tip of top section 102 may be spill guard tip 114 even when such an extension is present, and even when a tip of such an extension extends laterally beyond spill guard tip 114.

Bottom section 106 of bucket assembly 100 may extend from a lower end of curved portion 116. At least a portion of bottom section 106 may be substantially straight. Bottom section 106 may include a floor plate 124. A base edge 125 may be welded to an edge portion of floor plate 124. A cutting edge 126 may be bolted to base edge 125. A bottom surface 127 of cutting edge 126 may lie substantially flat on the ground when bucket assembly 100 is in a ground level position. Bottom surface 127 may be substantially parallel to a bottom surface of base edge 125.

Bottom section 106 may include a tip, such as a bucket tip 128, corresponding to the point on the bottom section 106 of the bucket furthest away from kinematic reaction point 120. The tip of bottom section 106 may include, for example, a point on base edge 125, but the tip of bottom section 106 does not include any teeth that may be coupled to bottom section 106.

First side section 108 may include a side plate 134, a side cutter 138, and a corner cutter 144 (removed for clarity in FIG. 2). First side section 108 may be coupled to a first side of spill guard 112, curved portion 116, and floor plate 124. Referring to FIG. 2, second side section 110 may include a similar side plate 135, side cutter 140, and corner cutter 144. Second side section 110 may be coupled to a second side of spill guard 112, curved portion 116, and floor plate 124, opposite the first side. Surfaces of first and second side sections 108 and 110, spill guard 112, curved portion 116, and floor plate 124, may define a receptacle 136 for holding a heap of material (not shown). As known in the art, the heap of material may fill receptacle 136, and in some cases, may extend in a pile out of receptacle 136.

Figure 3:
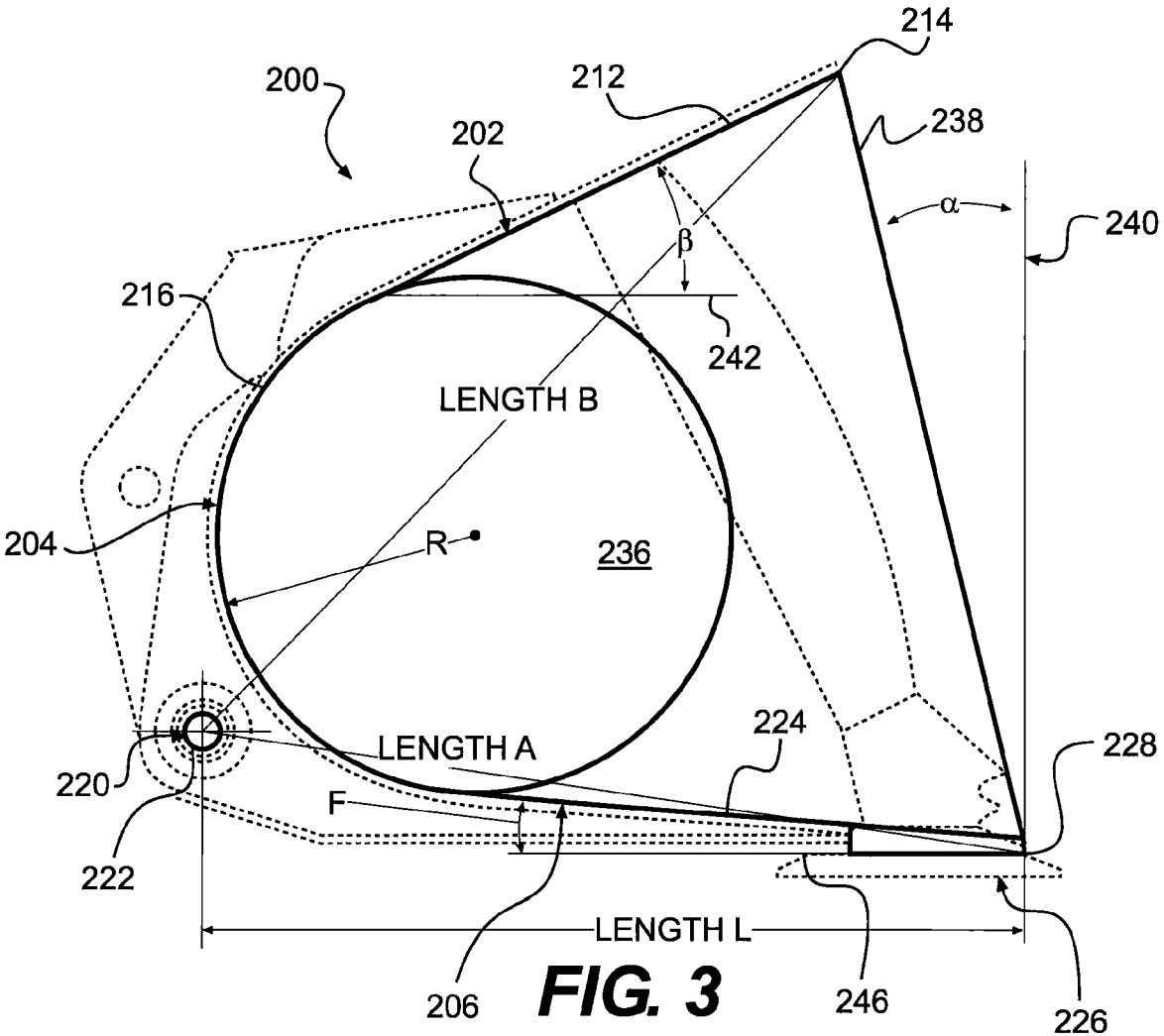
FIG. 3 is a simplified bucket diagram representing the performance enhancing bucket of FIGS. 1 and 2.

FIG. 3 shows a simplified bucket diagram 200 corresponding to bucket assembly 100 of FIGS. 1 and 2, in that the simplified bucket diagram 200 is shown overlaid on a dashed-line version of bucket assembly 100. Simplified bucket diagram 200 includes a top section 202, a middle section 204, a bottom section 206, a spill guard 212, a spill guard tip 214, a curved portion 216, a kinematic reaction point 220, a floor plate 224, a bucket tip 228 and a receptacle 236, that correspond to and represent top section 102, middle section 104, bottom section 106, spill guard 112, spill guard tip 114, curved portion 116, kinematic reaction point 120, floor plate 124, bucket tip 128, and receptacle 136, respectively, of bucket assembly 100. Simplified bucket diagram 200 also shows a strikeplane 238 represented by a line extending between the tips of top section 202 and bottom section 206, such as bucket tip 228 and spill guard tip 214.

A number of bucket parameters are identified in simplified bucket diagram 200, including an angle α, an angle β, a length A, a length B, a floor angle F, a length L, and a bucket radius R. Angle α may be equal to the angle of departure between a line 240 and strikeplane 238. Line 240 may include a line substantially perpendicular to a line 246 extending in a plane formed by the bottom surface of base edge 125 (FIG. 2), which may be parallel to the bottom surface 127 of cutting edge 126. Angle β may be equal to the angle of departure between a line 242 extending in a plane formed by a substantially straight portion of top section 102. Line 242 may include a line parallel to line 246. Length A may be equal to a distance between kinematic reaction point 220 and a tip of bottom section 206, such as bucket tip 228. Length B may be equal to a distance between kinematic reaction point 220 and the tip of top section 202, such as spill guard tip 214. A ratio of length A to length B is referred to herein as a loadability index A/B, the significance of which is described in greater detail below. Floor angle F may be equal to the angle of departure between line 246 and floor plate 224. Length L may be equal to a distance between kinematic reaction point 220 and bucket tip 228 line 246. Bucket radius R may be equal to the radius of at least a portion of a curved portion 216. It should be understood that the term "plane" may be substituted for the term "line" with respect to lines 240, 242, and 246. By selecting desired values for angle α, angle β, length A, length B, floor angle F, length L, and bucket radius R, a bucket may be provided with a desired geometry that may enhance machine performance.

A bucket's loadability index A/B may provide an indication of the loadability of the bucket. Values for length A and length B may be selected to achieve a loadability index A/B of approximately 1.0±0.05, to provide a bucket, such as bucket assembly 100, with a performance enhancing geometry. Examples of bucket assembly 100 are provided below.

EXAMPLE 1

Bucket assembly 100 may have a value for angle α of approximately 20.8°±3°, a value for angle β of approximately 26.0°±3°, a value for length A of approximately 1571 mm, a value for length B of approximately 1630 mm, a value for floor angle F of approximately 4.75°, a value for length L of approximately 1654 mm, a value for bucket radius R of approximately 490 mm, and a loadability index A/B of approximately 1.0±0.05.

EXAMPLE 2

Bucket assembly 100 may have a value for angle α of approximately 20.8°±3°, a value for angle β of approximately 26.0°±3°, a value for length A of approximately 1654 mm, a value for length B of approximately 1703 mm, a value for floor angle F of approximately 4.28°, a value for length L of approximately 1738 mm, a value for bucket radius R of approximately 490 mm, and a loadability index A/B of approximately 1.0±0.05.

EXAMPLE 3

Bucket assembly 100 may have a value for angle α of approximately 25°±3°, a value for angle β of approximately 50°±3°, a value for length A of approximately 1451 mm, a value for length B of approximately 1478 mm, a value for floor angle F of approximately 4°, a value for length L of approximately 1524 mm, a value for bucket radius R of approximately 440 mm, and a loadability index A/B of approximately 1.0±0.05.

EXAMPLE 4

Bucket assembly 100 may have a value for angle α of approximately 21.5°±3°, a value for angle β of approximately 47°±3°, a value for length A of approximately 1364 mm, a value for length B of approximately 1343 mm, a value for floor angle F of approximately 4°, a value for length L of approximately 1337 mm, a value for bucket radius R of approximately 420 mm, and a loadability index A/B of approximately 1.0±0.05.

EXAMPLE 5

Bucket assembly 100 may have a value for angle α of approximately 21.5°±3°, a value for angle β of approximately 47°±3°, a value for length A of approximately 1412 mm, a value for length B of approximately 1387 mm, a value for floor angle F of approximately 4°, a value for length L of approximately 1386 mm, a value for bucket radius R of approximately 420 mm, and a loadability index A/B of approximately 1.0±0.05.

EXAMPLE 6

Bucket assembly 100 may have a value for angle α of approximately 20.8°±3°, a value for angle β of approximately 37°±3°, a value for length A of approximately 2058 mm, a value for length B of approximately 2031 mm, a value for floor angle F of approximately 4°, a value for length L of approximately 2042 mm, a value for bucket radius R of approximately 470 mm, and a loadability index A/B of approximately 1.0±0.05.

EXAMPLE 7

Bucket assembly 100 may have a value for angle α of approximately 20.8°±3°, a value for angle β of approximately 37°±3°, a value for length A of approximately 1921 mm, a value for length B of approximately 1895 mm, a value for floor angle F of approximately 4.6°, a value for length L of approximately 1904 mm, a value for bucket radius R of approximately 470 mm, and a loadability index A/B of approximately 1.0±0.05.

EXAMPLE 8

Bucket assembly 100 may have a value for angle α of approximately 20.8°±3°, a value for angle β of approximately 37°±3°, a value for length A of approximately 1836 mm, a value for length B of approximately 1822 mm, a value for floor angle F of approximately 5°, a value for length L of approximately 1674 mm, a value for bucket radius R of approximately 470 mm, and a loadability index A/B of approximately 1.0±0.05.

Examples of bucket assembly 100 described above possess performance enhancing geometries. Differences between the examples demonstrate that some variability of the values for bucket parameters is contemplated. For example, values may vary depending on the desired overall size of bucket assembly 100. The overall size of bucket assembly 100 may be established by selecting a first value for length L. Based on the first value for length L, first values for lengths A and B may be selected that provide the desired value for the loadability index A/B. The selection of the first values for lengths L, A, and B may dictate values for floor angle F. For example, floor angle F may be set to achieve the desired value for the loadability index A/B. Similarly, bucket radius R may be adjusted to achieve the desired value for the loadability index A/B.

If, for example, it is desired for the overall size of bucket assembly 100 to be increased, such an increase may be achieved by increasing the value for length L from the first value to a second value greater than the first value. Based on the second value for length L, lengths A and B may be set to second values that are greater than the first values, while ensuring that the desired value for the loadability index A/B is substantially maintained. Values for floor angle F and/or bucket radius R may be adjusted to ensure the desired value for the loadability index A/B is substantially maintained. A similar process may be used to decrease the overall size of bucket assembly 100. As lengths A, B, and L change to adjust the overall size of bucket assembly 100, so does the location of strikeplane 238. It is contemplated that the strikeplane associated with the first values for lengths L, A, and B may be substantially parallel to the strikeplane associated with the second values for lengths L, A, and B.

Figure 4:
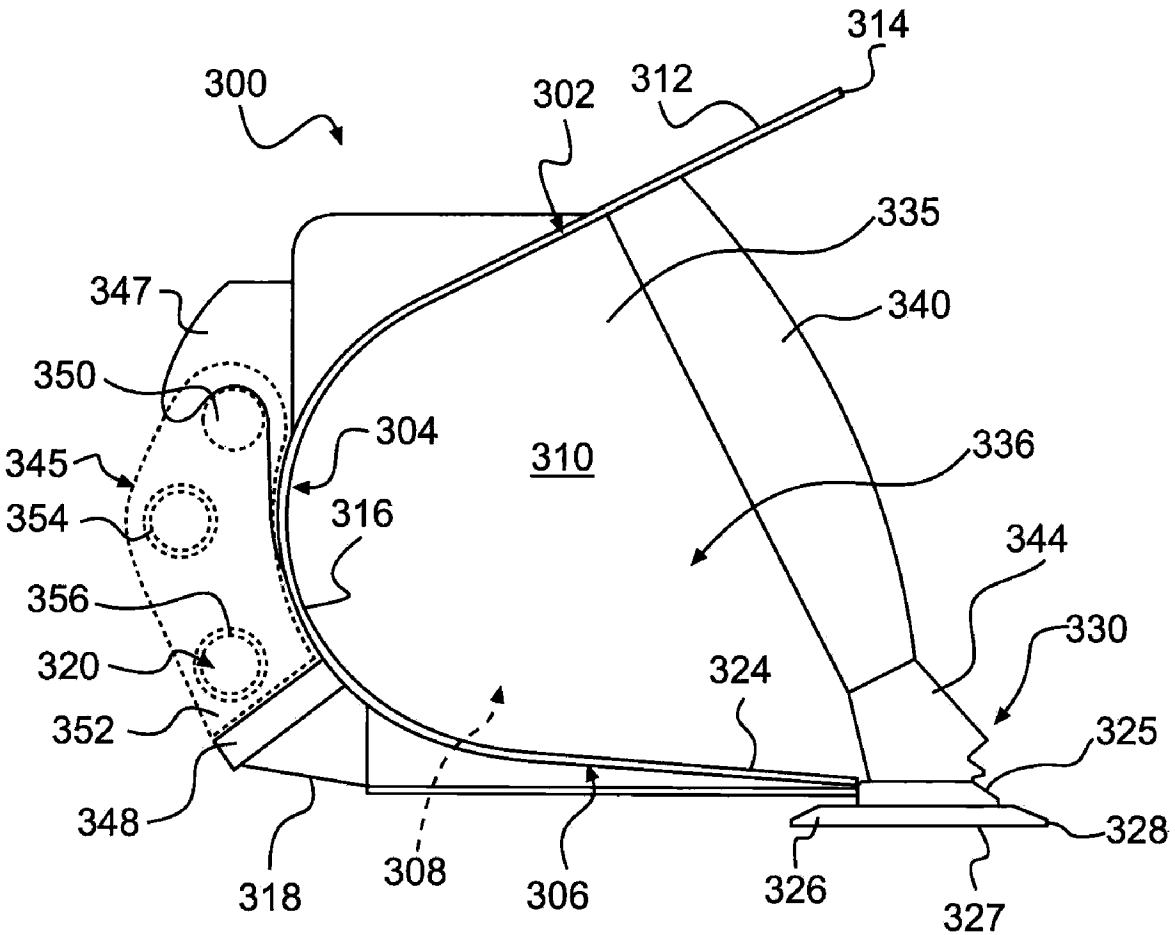
FIG. 4 is a side view of a performance enhancing bucket in a ground level position and a coupling assembly for attaching the performance enhancing bucket to a machine, according to another aspect of the disclosure.

A bucket assembly 300 is shown in FIG. 4. Bucket assembly 300 may include a top section 302, a middle section 304, a bottom section 306, a first side section (removed in FIG. 4 to illustrate the inside of bucket assembly 300) similar to first side section 108 of bucket assembly 100, and a second side section 310. Middle section 304 may include a curved portion 316.

Coupling components 318, which may include at least one hook member 347 and at least one abutment 348, may be coupled to a convex side of curved portion 316. It is contemplated that multiple hook members and/or multiple abutments may be positioned along the width of bucket assembly 300. Coupling components 318 may engage a coupling assembly 345 (shown in dashed lines in FIG. 4). Coupling assembly 345 may include at least one rod 350 configured to be received by hook member 347. Coupling assembly 345 may also include at least one wedge portion 352 configured to engage a surface of abutment 348. Coupling assembly 345 may be coupled to coupling components 318 by inserting rod 350 into the space defined by hook member 347, and then rotating wedge portion 352 into position above abutment 348. It is contemplated that a latching mechanism (not shown) may be provided on at least one of wedge portion 352 and abutment 348 to secure wedge portion 352 to abutment 348.

Coupling assembly 345 may include an upper pin hole or bore 354 and a kinematic reaction point 320. Upper pin hole or bore 354 may be configured to receive pin 18 of upper linkage 13 of machine 10. Kinematic reaction point 320 may include a lower pin hole or bore 356 configured to receive pin 16 (see FIG. 1) of machine 10. Bore 356 and pin 16 may act as a pivot point for coupling assembly 345, about which bucket assembly 300 may rotate relative to lower linkage 15. Linkage assembly 12 may rotate bucket assembly 300 about kinematic reaction point 320 as one or more operations are performed with bucket assembly 300.

Decoupling bucket assembly 300 may include separating wedge portion 352 from abutment 348 (for example by unlatching wedge portion 352 from abutment 348), moving wedge portion 352 away from abutment 348, and then withdrawing rod 350 from hook member 347. Coupling assembly 345 may remain coupled to linkage assembly 12 of machine 10 after decoupling.

Top section 302 of bucket assembly 300 may extend from an upper end of curved portion 316. Top section 302 may include a spill guard 312. Spill guard 312 may be formed by a portion of top section 302, or may be welded to another portion of top section 302. Spill guard 312 may have a width covering at least a portion of a width of bucket assembly 300, with the width of bucket assembly 300 extending from first side section 308 to second side section 310. Spill guard 312 may include a spill guard tip 314.

At least a portion of top section 302 may be substantially straight. Top section 302 may include a tip defined by a portion of top section 302 furthest from kinematic reaction point 320. The tip of top section 302 may include, for example, spill guard tip 314. An extension (not shown) may be coupled to top section 302, and may, for example, be at least partially mounted on a portion of top section 302, such as, for example, on spill guard 312. The extension may have a width less than the width of spill guard 312. For example, the extension may extend across a central portion of spill guard 312. The extension may include a tip portion extending laterally beyond spill guard tip 314. It should be understood that the tip of top section 302 may be spill guard tip 314 even when such an extension is present, and even when a tip of such an extension extends laterally beyond spill guard tip 314.

Bottom section 306 of bucket assembly 300 may extend from a lower end of curved portion 316. At least a portion of bottom section 306 may be substantially straight. Bottom section 306 may include a floor plate 324. A base edge 325 may be welded to an edge portion of floor plate 324. A cutting edge 326 may be bolted to base edge 325. A bottom surface 327 of cutting edge 326 may lie substantially flat on the ground when bucket assembly 300 is in a ground level position. Bottom surface 327 may be substantially parallel to a bottom surface of base edge 325.

Bottom section 306 may include a tip, such as a bucket tip 328, corresponding to the point on the bottom section 306 of the bucket furthest away from kinematic reaction point 320. The tip of bottom section 306 may include, for example, a point on base edge 325. The tip of bottom section 306 does not include any teeth that may be coupled to bottom section 306.

The first side section of bucket assembly 300, removed from FIG. 4 to show details of the inside of bucket assembly 300, may include a side plate, a side cutter, and a corner cutter, similar to those of first side section 108 of bucket assembly 100. The first side section may be coupled to a first side of spill guard 312, curved portion 316, and floor plate 324. Second side section 310 may include a similar side plate 335, side cutter 340, and corner cutter 344. Second side section 310 may be coupled to a second side of spill guard 312, curved portion 316, and floor plate 324, opposite the first side. Surfaces of the first and second side sections, spill guard 312, curved portion 316, and floor plate 324, may define a receptacle 336 for holding a heap of material (not shown). As known in the art, the heap of material may fill receptacle 336, and in some cases, may extend in a pile out of receptacle 336.

Figure 5:
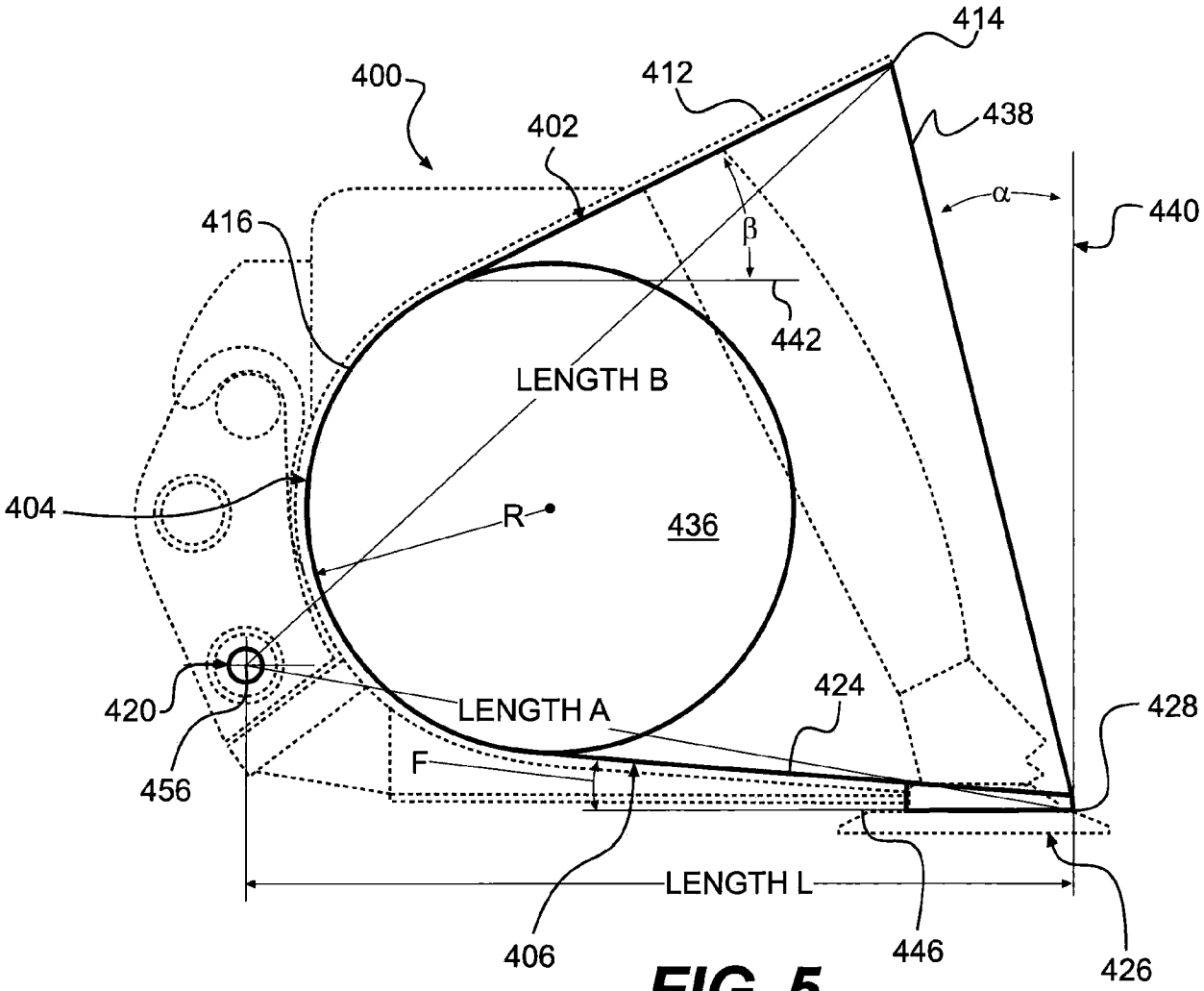
FIG. 5 is a simplified bucket diagram representing the performance enhancing bucket and coupling assembly of FIG. 4.

FIG. 5 shows a simplified bucket diagram 400 corresponding to bucket assembly 300 of FIG. 4, in that the simplified bucket diagram 400 is shown overlaid on a dashed-line version of bucket assembly 300 and coupling assembly 345. Simplified bucket diagram 400 includes a top section 402, a middle section 404, a bottom section 406, a spill guard 412, a spill guard tip 414, a curved portion 416, a kinematic reaction point 420 (defined by a bore 456), a floor plate 424, a bucket tip 428, and a receptacle 436, that correspond to and represent top section 302, middle section 304, bottom section 306, spill guard 312, spill guard tip 314, curved portion 316, kinematic reaction point 320, floor plate 324, bucket tip 328, and receptacle 336, respectively, of bucket assembly 300. Simplified bucket diagram 400 also shows a strikeplane 438 represented by a line extending between the tips of top section 402 and bottom section 406, such as bucket tip 428 and spill guard tip 414.

A number of bucket parameters are identified in simplified bucket diagram 400, including an angle α, an angle β, a length A, a length B, a floor angle F, a length L, and a bucket radius R. Angle α may be equal to the angle of departure between a line 440 and strikeplane 438. Line 440 may include a line substantially perpendicular to a line 446 extending in a plane formed by the bottom surface of base edge 325 (FIG. 4), which may be substantially parallel to bottom surface 327 of cutting edge 326. Angle β may be equal to the angle of departure between a line 442 extending in a plane formed by a substantially straight portion of top section 402. Line 442 may include a line parallel to line 446. Length A may be equal to a distance between kinematic reaction point 420 and a tip of bottom section 406, such as bucket tip 428. Length B may be equal to a distance between kinematic reaction point 420 and the tip of top section 402, such as spill guard tip 414. A ratio of length A to length B is referred to herein as a loadability index A/B, the significance of which is described in greater detail below. Floor angle F may be equal to the angle of departure between line 446 and floor plate 424. Length L may be equal to a distance between kinematic reaction point 420 and bucket tip 428 along line 446. Bucket radius R may be equal to the radius of at least a portion of a curved portion 416. It should be understood that the term "plane" may be substituted for the term "line" with respect to lines 440, 442, and 446. By selecting desired values for angle α, angle β, length A, length B, floor angle F, length L, and bucket radius R, a bucket may be provided with a desired geometry that may enhance machine performance.

A bucket's loadability index A/B may provide an indication of the loadability of the bucket. Values for length A and length B may be selected to achieve a loadability index A/B of approximately 1.0±0.05, to provide a bucket, such as bucket assembly 300, with a performance enhancing geometry. Examples of bucket assembly 300 are provided below.

EXAMPLE 9

Bucket assembly 300 may have a value for angle α of approximately 25°±3°, a value for angle β of approximately 50°±3°, a value for length A of approximately 1597 mm, a value for length B of approximately 1503 mm, a value for floor angle F of approximately 4.0°, a value for length L of approximately 1568 mm, a value for bucket radius R of approximately 440 mm, and a loadability index A/B of approximately 1.0±0.05.

EXAMPLE 10

Bucket assembly 300 may have a value for angle α of approximately 25°±3°, a value for angle β of approximately 50°±3°, a value for length A of approximately 1644 mm, a value for length B of approximately 1572 mm, a value for floor angle F of approximately 3.5°, a value for length L of approximately 1616 mm, a value for bucket radius R of approximately 440 mm, and a loadability index A/B of approximately 1.0±0.05.

EXAMPLE 11

Bucket assembly 300 may have a value for angle α of approximately 25.0°±3°, a value for angle β of approximately 50.0°±3°, a value for length A of approximately 1680 mm, a value for length B of approximately 1592 mm, a value for floor angle F of approximately 3.5°, a value for length L of approximately 1652 mm, a value for bucket radius R of approximately 440 mm, and a loadability index A/B of approximately 1.0±0.05.

EXAMPLE 12

Bucket assembly 300 may have a value for angle α of approximately 21.5°±3°, a value for angle β of approximately 47°±3°, a value for length A of approximately 1366 mm, a value for length B of approximately 1336 mm, a value for floor angle F of approximately 4°, a value for length L of approximately 1337 mm, a value for bucket radius R of approximately 420 mm, and a loadability index A/B of approximately 1.0±0.05.

EXAMPLE 13

Bucket assembly 300 may have a value for angle α of approximately 21.5°±3°, a value for angle β of approximately 47°±3°, a value for length A of approximately 1412 mm, a value for length B of approximately 1387 mm, a value for floor angle F of approximately 3.65°, a value for length L of approximately 1386 mm, a value for bucket radius R of approximately 420 mm, and a loadability index A/B of approximately 1.0±0.05.

Examples of bucket assembly 300 described above possess performance enhancing geometries. Differences between the examples demonstrate that some variability of the values for bucket parameters is contemplated. For example, values may vary depending on the desired overall size of bucket assembly 300. The overall size of bucket assembly 300 may be established in a manner similar to how the overall size of bucket assembly 100 may be established.

INDUSTRIAL APPLICABILITY

The foregoing embodiments of bucket assembly 100 and bucket assembly 300 may be coupled to machine 10, such as the wheel loader shown in FIG. 1, for use with handling material and enhancing overall machine performance. Operations that may be performed with bucket assembly 100 may include using a linkage assembly 12 to position bucket assembly 100 in a lowered and unracked position, which may also be a ground level position of bucket assembly 100. Machine 10 may use bucket assembly 100 to penetrate a pile of material (not shown) with bucket assembly 100 held in the lowered and unracked position. Machine 10 may move bucket assembly 100 to a racked position, with bucket assembly 100 tilted back toward machine 10, to scoop material into bucket assembly 100. Machine may lift bucket assembly 100 from the racked position into a carry position as machine 10 delivers the material to another location. When bucket assembly 100 is in the carry position, the scooped material may sit in a heap in bucket assembly 100. Machine 10 may move bucket assembly 100 into a raised and racked position as machine 10 approaches a dumping location, such as a pile and/or a receptacle of an off-highway truck (not shown). Machine 10 may move bucket assembly 100 into the fully raised position to position the material above the dumping location, and into a tilted position to dump the material in the dumping location. Machine 10 may move bucket assembly 100 from any of the positions described above to any of the other positions described above, and to any positions in between, while performing material handling operations at a work site. It should be understood that machine 10 may also move bucket assembly 300 to and from any of the above-described positions while performing material handling operations at a work site.

The performance enhancing characteristics of buckets 100 and 300 may come as a result of the values of their parameters. For example, bucket assembly 100 may include bucket parameter values that provide bucket assembly 100 with a loadability index A/B of approximately 1.0±0.05. By maintaining the loadability index A/B of bucket assembly 100 in that range, a floor plate 124 of bucket assembly 100 may be sized and oriented to penetrate into and withdraw from a pile of material quickly, while simultaneously ensuring that the center of mass of material resting on floor plate 124 after penetration is well positioned. The center of mass of material is well positioned if it is close enough to linkage assembly 112 to allow machine 10 to stay balanced, and to allow machine 10 to move the material without expending an excessive amount of fuel. The center of mass of material is not well positioned if it is so far away from linkage assembly 112 that machine 10 may become unbalanced (e.g., tip forward), or have to expend an excessive amount of fuel to generate enough force to move the material. If, for example, the length of floor plate 124 is made so long that the loadability index A/B is not maintained in the desired range, bucket assembly 100 may penetrate and withdraw from the pile quickly, but the center of mass of the material may not be well positioned in that it may be positioned so far away from linkage assembly 112 that the above-noted issues of machine imbalance and fuel waste arise. Thus, by maintaining the loadability index A/B in the desired range, the length of floor plate 124 is kept proportional to the length of a spill guard 112, and will not be so long that the center of mass of material on floor plate 124 is not well positioned.

Further, the desired loadability index A/B of bucket assembly 100 may allow the machine operator to have better line of sight to a pile of material, since the length of spill guard 112 is kept proportional to the length of floor plate 124. If the length of spill guard 112 is increased to a point where the loadability index A/B of bucket assembly 100 falls outside the desired range, the machine operator may have difficulty seeing over spill guard 112. By maintaining the loadability index A/B in the desired range, the length of spill guard 112 is kept proportional to the length of floor plate 124, and will not be so long that the machine operator's line of sight to the pile is obstructed. As such, the machine operator may accurately position and use bucket assembly 100, thus reducing time spent chewing at the pile, and the overall time required to load material into bucket assembly 100. Additionally, the desired loadability index A/B of bucket assembly 100 helps to ensure that, when bucket assembly 100 is racked or tilted back toward linkage assembly 12, the machine operator's line of sight to a pile of material in bucket assembly 100 is not obstructed by an excessively long spill guard 112. This may make it easier for the machine operator to visually identify when bucket assembly 100 is full, so that time and fuel is not wasted trying to pile additional material into a fully loaded bucket.

Furthermore, the desired loadability index A/B of bucket assembly 100 may keep material in bucket assembly 100 positioned such that less material spills out as the material is transported. For example, when the loadability index A/B of bucket assembly 100 is kept at approximately 1.0±0.05, this ensures that when bucket assembly 100 is racked, the pile of material in and above a receptacle 136 of bucket assembly 100 is substantially centered with respect to spill guard 112 and floor plate 124. This centering assists with keeping the material from spilling out over spill guard 112 and floor plate 124. All of the advantages associated with the desired loadability index A/B may help improve cycle times, reduce operator effort, and allow more material to be moved per unit of fuel.

Bucket assembly 300 may include bucket parameter values that provide bucket assembly 300 with a loadability index A/B of approximately 1.0±0.05. By maintaining the loadability index A/B of bucket assembly 300 in that range, floor plate 324 of bucket assembly 300 may be sized and oriented to penetrate into and withdraw from a pile of material quickly, while simultaneously ensuring that the center of mass of material resting on floor plate 324 after penetration is well positioned, in the same way such benefits are achieved for bucket assembly 100 with the desired loadability index A/B of bucket assembly 100. Further, the desired loadability index A/B of bucket assembly 300 may allow the machine operator to have better line of sight to a pile of material by keeping the length of spill guard 312 proportional to the length of floor plate 324, and may keep material in bucket assembly 300 in a centered position with respect to spill guard 312 and floor plate 324 when bucket assembly 300 is racked, to reduce spillage, in the same ways that these advantages are achieved with bucket assembly 100 by using the desired loadability index A/B of bucket assembly 100.

It will be apparent to those skilled in the art that various modifications and variations can be made in the disclosed buckets without departing from the scope of the disclosure. Additionally, other embodiments of the disclosed buckets will be apparent to those skilled in the art from consideration of the specification. It is intended that the specification and examples be considered as exemplary only, with a true scope of the disclosure being indicated by the following claims and their equivalents.

What is claimed is:

1. A machine bucket assembly, comprising:

a kinematic reaction point about which the machine bucket is configured to rotate;

a bottom section, wherein a distance between the kinematic reaction point and a tip of the bottom section has a first length;

a top section, wherein a distance between the kinematic reaction point and a tip of the top section has a second length, a ratio of the first length to the second length being equal to a value between approximately 0.95 and 1.05; and a middle section located between the bottom section and the top section, wherein at least a portion of the middle section is curved.

2. The machine bucket of claim 1, wherein a bottom surface of at least a portion of the bottom section defines a cutting edge plane.

3. The machine bucket of claim 2, wherein an angle between a plane perpendicular to the cutting edge plane and a plane extending between the tip of the bottom section and the tip of the top section is equal to a value (α) between approximately 17.8° and 23.8°.

4. The machine bucket of claim 2, wherein an angle between a plane formed by the top section and the cutting edge plane is equal to a value (β) between approximately 23.0° and 29.0°.

5. The machine bucket of claim 2, wherein an angle between a plane perpendicular to the cutting edge plane and a plane extending between the tip of the bottom section and the tip of the top section is equal to a value (α) between approximately 22.0° and 28.0°.

6. The machine bucket of claim 2, wherein an angle between a plane formed by the top section and the cutting edge plane is equal to a value (β) between approximately 47.0° and 53.0°.

7. The machine bucket of claim 2, wherein an angle between a plane perpendicular to the cutting edge plane and a plane extending between the tip of the bottom section and the tip of the top section is equal to a value (α) between approximately 18.5° and 24.5°.

8. The machine bucket of claim 2, wherein an angle between a plane formed by the top section and the cutting edge plane is equal to a value (β) between approximately 44.0° and 50.0°.

9. A machine bucket assembly, comprising:

a kinematic reaction point;

a bottom section, wherein a distance between the kinematic reaction point and a tip of the bottom section has a first length, and a bottom surface of at least a portion of the bottom section defines a cutting edge plane;

a top section, wherein a distance between the lower pin hole and a tip of the top section has a second length, a ratio of the first length to the second length being equal to a value between approximately 0.95 and 1.05;

a first angle between a plane perpendicular to the cutting edge plane and a plane extending between the tip of the bottom section and the tip of the top section being equal to a value (α) between approximately 17.8° and 23.8°; and a second angle between a plane formed by the top section and the cutting edge plane being equal to a value (β) between approximately 23.0° and 29.0°.

10. The machine bucket of claim 9, wherein the ratio of the first length to the second length is approximately 0.96.

11. The machine bucket of claim 9, wherein the ratio of the first length to the second length is approximately 0.97.

12. The machine bucket of claim 9, wherein the first angle is approximately 21°.

13. The machine bucket of claim 9, wherein the second angle is approximately 26°.

14. The machine bucket of claim 9, wherein the bottom section includes a cutting edge, a bottom surface of the cutting edge forms the cutting edge plane, and a tip of the cutting edge forms the tip of the bottom section.

15. The machine bucket of claim 9, further including a middle section located between the bottom section and the top section, wherein at least a portion of the middle section includes a radius of curvature of approximately 490 mm.

16. A machine bucket assembly, comprising:

a kinematic reaction point;

a bottom section, wherein a distance between the kinematic reaction point and a tip of the bottom section has a first length, and a bottom surface of at least a portion of the bottom section defines a cutting edge plane;

a top section, wherein a distance between the kinematic reaction point and a tip of the top section has a second length, a ratio of the first length to the second length being equal to a value between approximately 0.95 and 1.05;

a first angle between a plane perpendicular to the cutting edge plane and a plane extending between the tip of the bottom section and the tip of the top section being equal to a value (α) between approximately 18.5° and 24.5°; and a second angle between a plane formed by the top section and the cutting edge plane being equal to a value (β) between approximately 44.0° and 50.0°.

17. The machine bucket of claim 16, wherein the ratio of the first length to the second length is approximately 1.02.

18. The machine bucket of claim 16, wherein the first angle is approximately 22°.

19. The machine bucket of claim 16, wherein the second angle is approximately 47°.

20. The machine bucket of claim 16, further including a middle section located between the bottom section and the top section, wherein at least a portion of the middle section includes a radius of curvature of approximately 420 mm.

* * * * *